United States Patent [19]

Scarr et al.

[11] Patent Number: 4,527,152

[45] Date of Patent: Jul. 2, 1985

[54] ANTI-SHOPLIFTING SYSTEM

[75] Inventors: Roger Scarr, Pickering, Canada; Edward R. Fearon, Richardson, Tex.

[73] Assignee: Shin International, Inc., Southfield, Mich.

[21] Appl. No.: 186,003

[22] Filed: Sep. 10, 1980 (Under 37 CFR 1.47)

[30] Foreign Application Priority Data

Sep. 14, 1979 [CA] Canada ..... 335657

[51] Int. Cl.[3] ..... G08B 13/26

[52] U.S. Cl. ..... 340/572

[58] Field of Search ..... 340/572

[56] References Cited

U.S. PATENT DOCUMENTS

| | | | |
|---|---|---|---|
| 3,790,945 | 2/1974 | Ferron | 340/572 |
| 3,820,104 | 6/1974 | Ferron | 340/572 |
| 3,938,125 | 2/1976 | Benassi | 340/572 |
| 4,123,749 | 10/1978 | Hartmann et al. | 340/572 |
| 4,251,808 | 2/1981 | Lichtblau | 340/572 |
| 4,260,990 | 4/1981 | Lichtblau | 340/572 |
| 4,300,183 | 11/1981 | Richardson | 340/572 |

*Primary Examiner*—Glen R. Swann

*Attorney, Agent, or Firm*—Gifford, VanOphem, Sheridan, Sprinkle & Nabozny

[57] ABSTRACT

An electronic security system to detect the presence of an object which has had a label affixed thereto when said object passes through a surveillance zone comprising an oscillatory electromagnetic interrogation field having three separate and distinct vector components produced by driving the transmitting coils located in housings on either side of said surveillance zone with an alternating power source repetitively in and out of phase with respect to one another so as to form magnetic lines of flux having one vector component in the in-phase mode and two vector components in the out-of-phase mode. The signals generated by the label are received by coils in said housing and are processed by electronic circuitry adapted to distinguish said label signals from spurious signals with a high degree of accuracy. The label can be deactivated so as to pass through the surveillance zone without triggering a system response.

31 Claims, 28 Drawing Figures

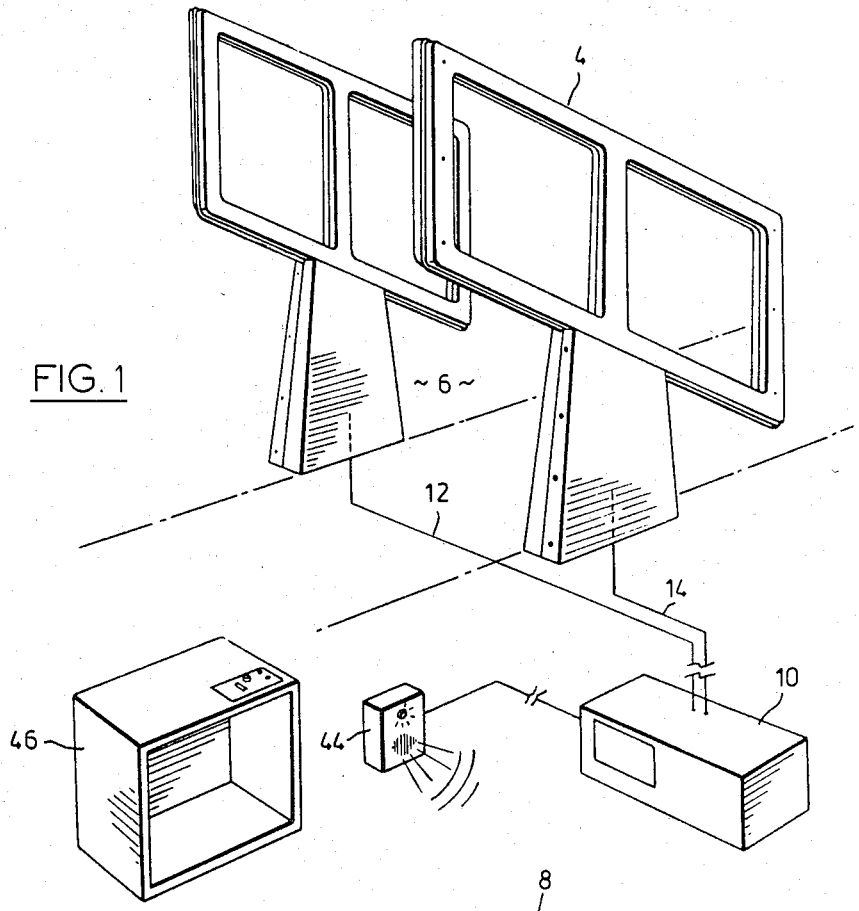
FIG. 1
FIG. 3
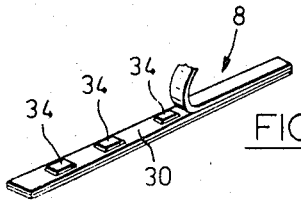
FIG. 2
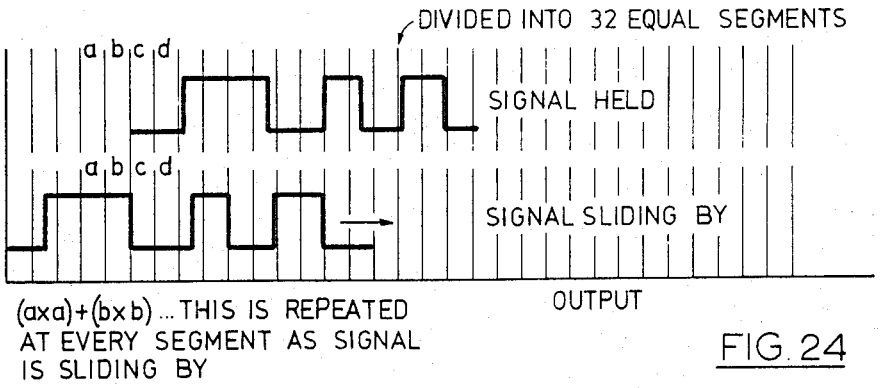
FIG. 24

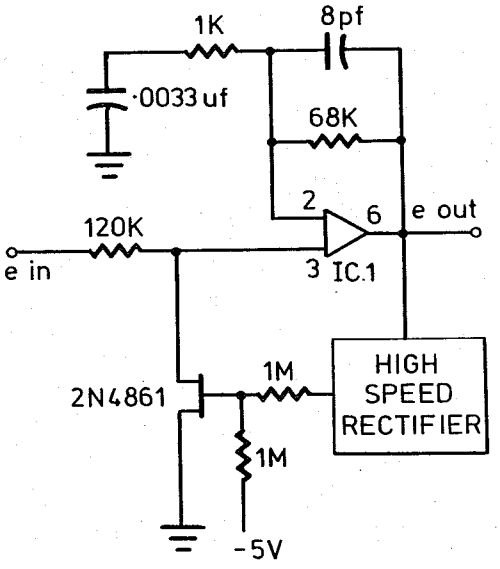
FIG 19a
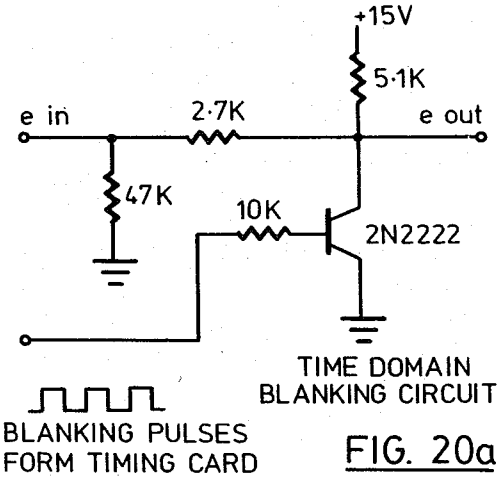
FIG. 20a
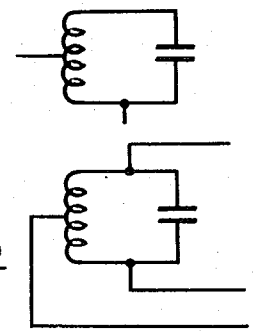
FIG. 7a
FIG. 7b
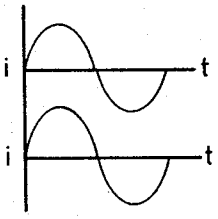
FIG. 8a
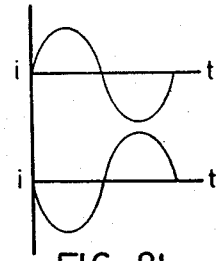
FIG. 8b
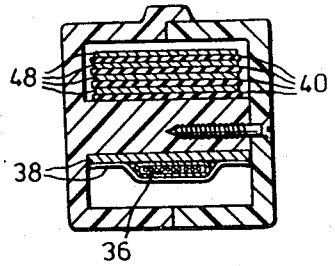
FIG. 5
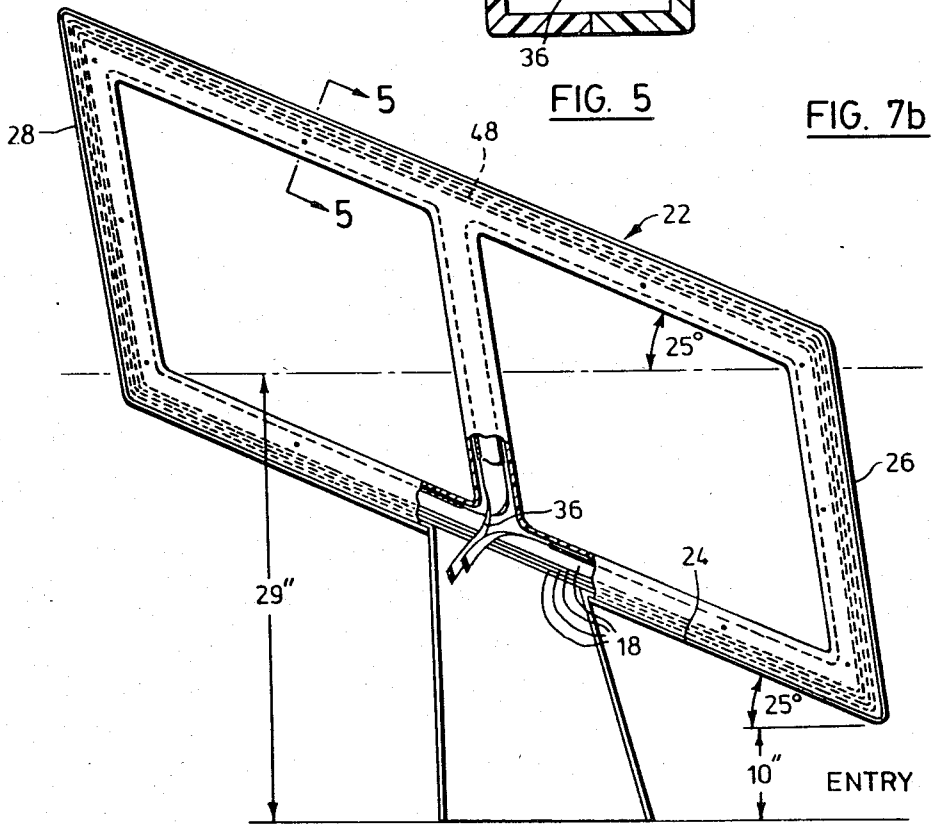
FIG. 4

TIME GATING SIGNAL

ANTI-SHOPLIFTING SYSTEM

FIELD OF INVENTION

This invention relates to a method and apparatus for surveiling articles and in particular to an improvement in a method and apparatus for detecting or preventing the theft of articles of value and more particularly it concerns the method and apparatus capable of distinguishing labels from other objects within an oscillatory electromagnetic field.

BACKGROUND TO INVENTION

There are in existence several systems for detecting or preventing the theft of articles of value. One of these corresponds to U.S. Pat. No. 3,292,080 granted to E. M. Trikilis on Dec. 13, 1966 which makes use of a magnetometer and utilizes a magnetized object which identifies the article unless check-out procedure has removed the magnetism from the object.

Another system involves radioactive material which emits nuclear radiation. When the label containing the magnetic material is removed from the merchandise, the radiation is no longer emitted, and therefore radiation detectors situated in the doorway are not energized. On the other hand, if the radiation emitters remain on the merchandise, doorway sensors of nuclear radiation react, and security personnel are in a position to prevent the theft. However, there are severe health problems with this system involving danger to people from the nuclear radiation.

A further system involves the use of a radio frequency generating device imbedded in a rubber pad. The radio frequency emitting device is fastened to articles and if not removed will energize radio frequency detecting antenna at the doorway. In the normal course of events, when the merchandise is sold, a special fastener is unlocked and the radio frequency emitter is removed from the clothing at the time it is sold, permitting the buyer to pass through the doorway without attracting the attention of the store detectives. However, this system is extremely costly and is therefore undesirable.

The following United States patents illustrate a number of alternative proposals which will serve as background to the invention described and illustrated herein namely:

U.S. Pat. No. 3,631,442;
U.S. Pat. No. 3,747,086;
U.S. Pat. No. 3,754,226;
U.S. Pat. No. 3,790,945;
U.S. Pat. No. 3,820,103.

OBJECTS OF THE INVENTION

The principal object of this invention relates to providing an improved method and apparatus for detecting or preventing the theft of articles of value.

Another very important object of this invention is to provide electrical circuitry which has inherently high resolution characteristics so as to distinguish between marker signals from those of other signals such as pop cans or key chains.

It is a further object of this invention to provide a method for generating an oscillating magnetic field in three vectors.

Still another very important object of this invention is to provide an apparatus for generating an oscillating magnetic field within a surveillance zone whereby said oscillating magnetic field has three vector components so as to eliminate blind spots to the passage of a label through said surveillance zone.

FEATURES OF INVENTION

It is a feature of this invention to provide an apparatus for detecting the passage of an object through a surveillance zone comprising a transmitting coil for generating an oscillatory electromagnetic interrogation field within the surveillance zone, a label secured to an object, whereby said label is adapted to cut or link up with the electromagnetic field during its traversal through the electromagnetic interrogation field regardless of the label's spacial orientation, and thereby generating signals captured by a receiving coil including electronic circuitry adapted to set off an alarm.

More particularly, the electronic circuitry is adapted to minimize distortion of the generated signal by the label. The electronic circuitry is also adapted so as to differentiate label signals from other signals such as pop cans generating lower harmonics. Foreign objects such as tin cans or chairs emit harmonics up to and including the 50th harmonic when in a strong enough magnetic field.

More particularly, the label utilized has a maximum permeability of 100,000 and a coercive force of 0.05 oersteds.

It is a further feature of this invention to provide for a field generating system which shall generate sufficient lines of flux to switch a label in any one of three vectors.

It is a further feature of this invention to provide for a broad band passive fundamental filter and signal amplifier system receiver antenna which while having a signal gain of ten substantially nulls the fundamental frequency of the generated oscillating magnetic field and is made sufficiently lossy such that it does very little or no wave shaping to the signal generated by the label.

More particularly, it is a feature of this invention to provide for electronic circuitry capable of processing the signal such that it is not distorted or wave shaped and the signal retains its inherent characteristics.

It is a further feature of this invention to provide coherent filtering of said signal generated by the label from other signals.

Yet another feature of this invention resides in providing transmitting coils capable of being driven in and out of phase with respect to one another so as to generate oscillating magnetic lines of flux having one vector in the in phase mode and two vectors in the out of phase mode. The label is adapted to cut or link up with one or more of the vectors.

It is another important feature of this invention that the phase of the receiving coils match that of the transmitting coil so as to maximize the capture of signals generated by a label in response to the in and out phase generation of an oscillating magnetic field produced by the transmitting coils.

Still another important feature of this invention resides in providing for transmitting coils having a parallelogram configuration inclined 25° to the horizontal capable of generating magnetic lines of flux equivalent to a parallelogram twice its size.

More particularly, it is a feature of this invention to provide electronic circuitry capable of time domain blanking and signal recognition. The signal may be recognized by utilizing pulse width detection or correlation.

It is a further feature of this invention to provide for a method for detecting the presence of an object when the object is in an interrogation zone having an oscillatory electromagnetic field. More particularly, the method comprises of securing to the object a label capable of generating signals when placed in the surveillance zone, whereby the signals are captured by receiving coils including electronic circuitry adapted to set off an alarm.

More particularly, the method includes labels capable of generating signals of low harmonics such that when the label is excited by an oscillating electromagnetic field having a fundamental frequency of 12.5 HKz the uppermost detectable signal generated by the label will be approximately the 160th harmonic or 2 MHz.

BRIEF DESCRIPTION OF DRAWINGS

These and other objects and features will become apparent in the following description to be read in conjunction with the sheets of drawings in which:

FIG. 1 is a perspective view of the anti-shoplifting system illustrating coil housing units, electronic circuitry device, and alarm.

FIG. 2 is a perspective view of the label illustrating its internal magnetic materials.

FIG. 3 is a perspective view of the deactivating system.

FIG. 4 is a side elevational view of one of the coil housing units which includes a partially broken view to illustrate its internal components.

FIG. 5 is a cross-sectional view of the coil housing unit taken along the lines 5—5 in FIG. 4 revealing the transmitting coil and receiving coil.

FIG. *7a* is a schematic illustration of the interconnection of the transmitting coil in the constant mode.

FIG. *7b* is a schematic illustration of the interconnection of the transmitting coil in the alternating mode.

FIG. *8a* is a graphic illustration of the alternating current along corresponding points of the transmitting coil when driven in phase.

FIG. *8b* is a graphic illustration of the alternating current along corresponding points of the transmitting coil when driven out of mode.

Figure 9:
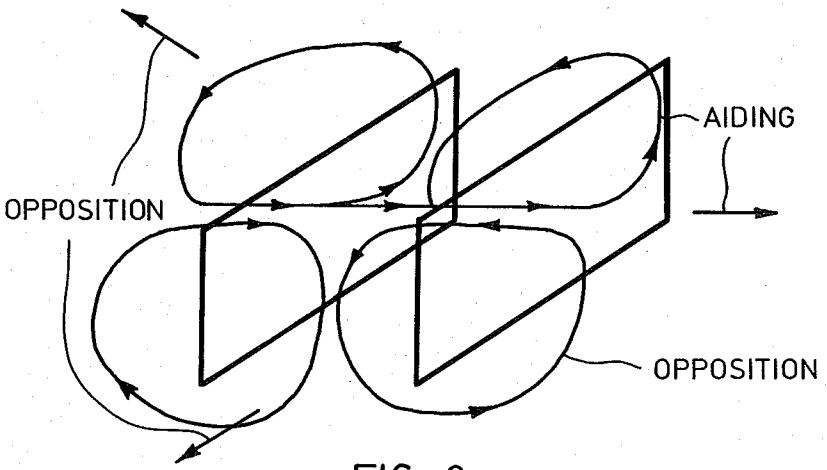

FIG. 9 is a diagram to assist in the explanation of generated vectors.

Figure 10:
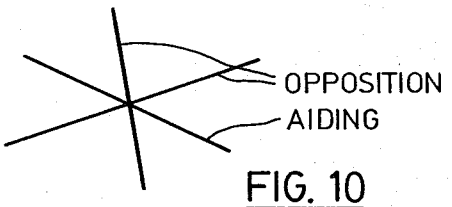

FIG. 10 is a further diagram to assist in the explanation of generated vectors.

Figure 11:
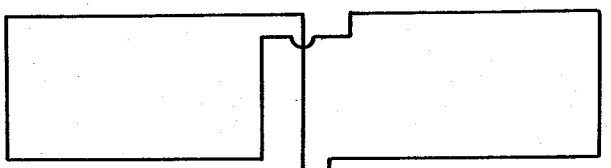

FIG. 11 is a diagrammatical view of the receiving coils mounted within the coil housing units.

Figure 12:
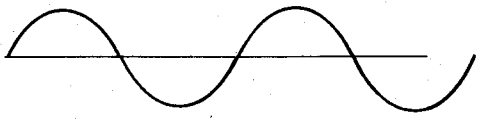

FIG. 12 is a graphic illustration of the fundamental frequency.

Figure 13:
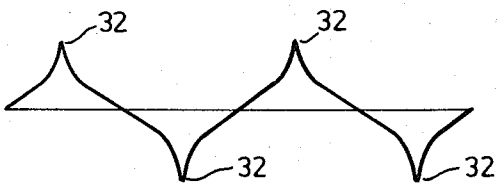

FIG. 13 is a graphic illustration of the fundamental frequency including the fundamental frequency of the signal generated by the label.

Figure 14:
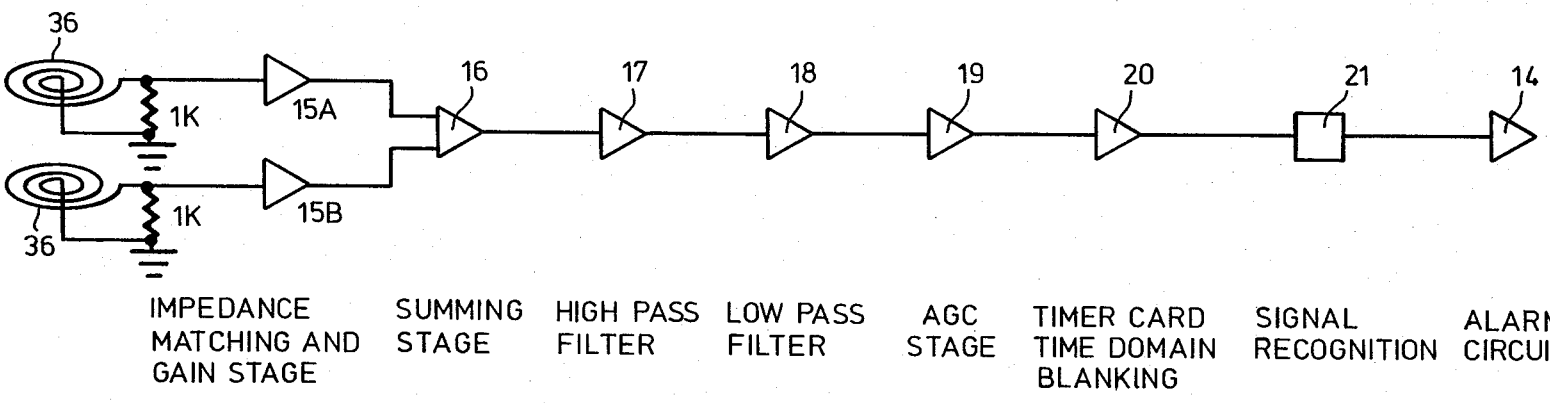

FIG. 14 is a block diagram illustrating the various components in the electronic circuitry device.

Figure 15:
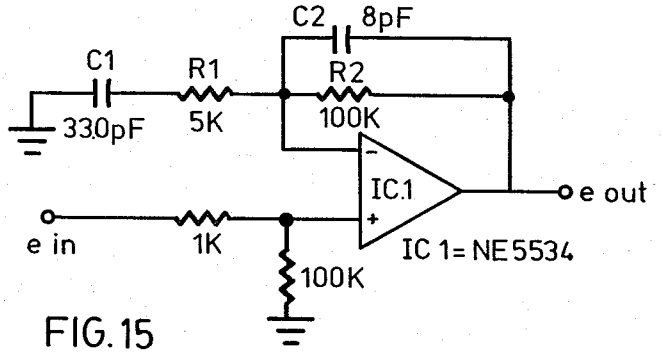

FIG. 15 is a schematic illustration of the impedance matching and gain stage.

Figure 16:
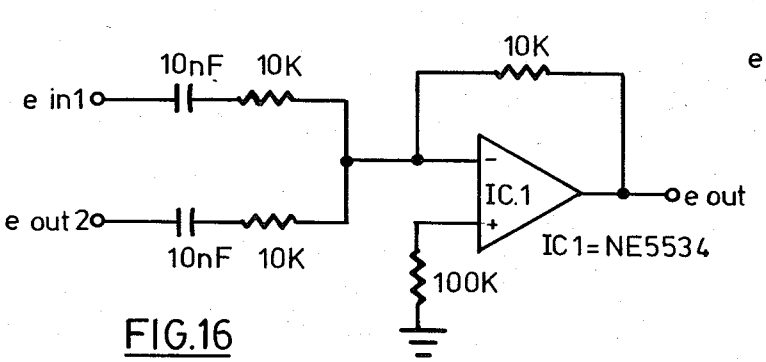

FIG. 16 is a schematic illustration of the summing stage.

Figure 17:
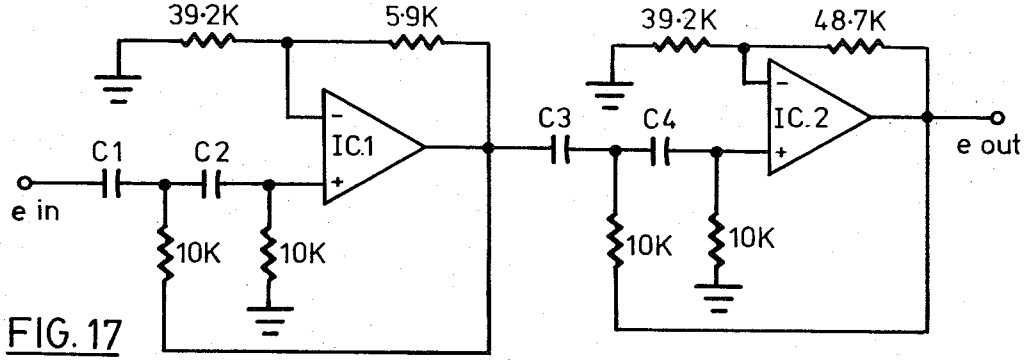

FIG. 17 is a schematic illustration of the high-pass filter.

Figure 18:
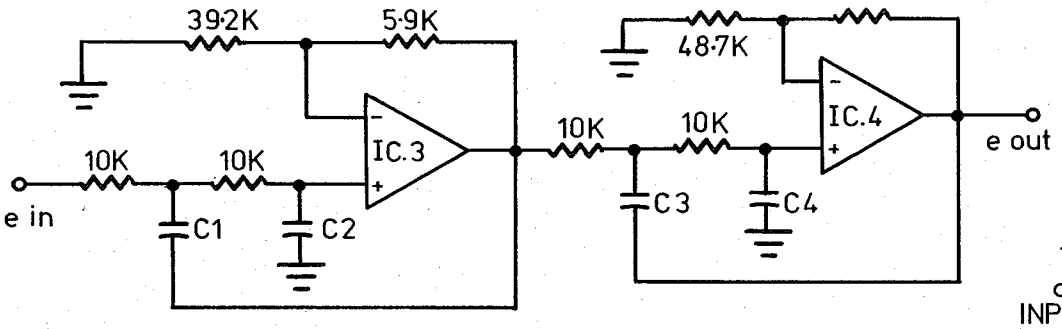

FIG. 18 is a schematic illustration of the low-pass filter.

Figure 19:
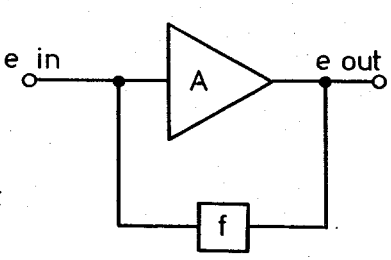

FIG. 19 is a schematic illustration of the automatic gain control stage.

FIG. 19*a* is a schematic illustration of the automatic gain control stage as in the preferred embodiment.

Figure 20:
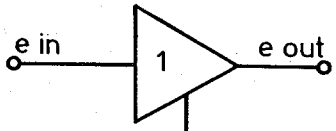

FIG. 20 is a schematic illustration of the timer card and time domain blanking stage.

FIG. 20*a* is a schematic illustration of the timer card and time domain blanking stage used in the preferred embodiment.

Figure 21:
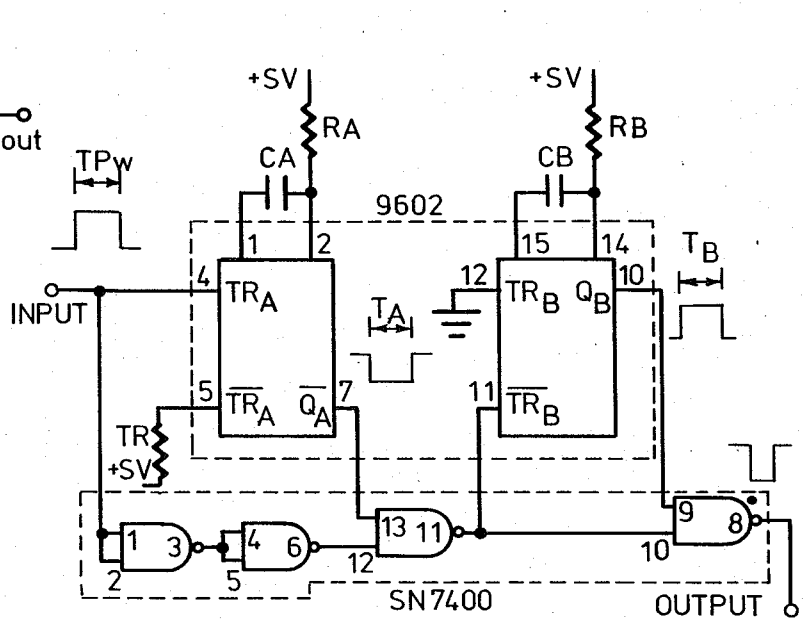

FIG. 21 is a schematic illustration of the pulse width detection of the preferred embodiment.

Figure 22:
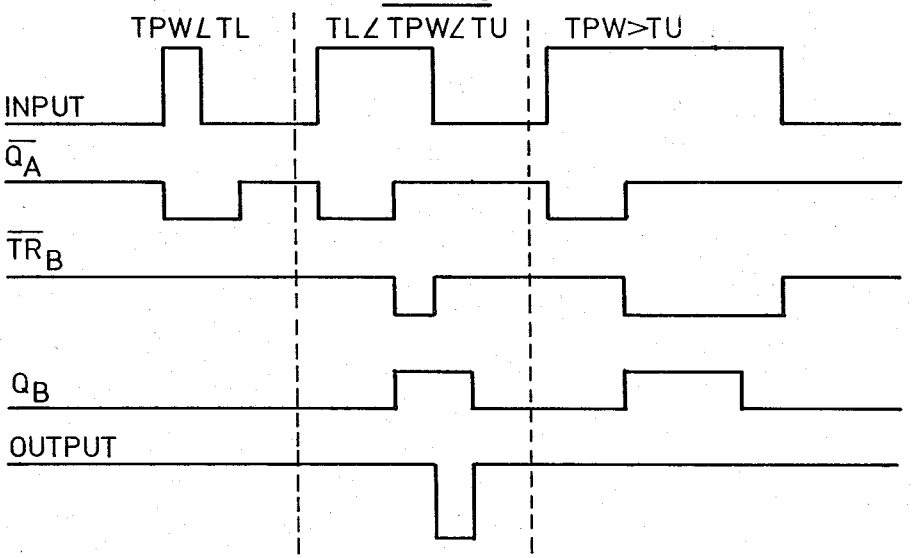

FIG. 22 is a diagram to assist in the explanation of the pulse width detection system of FIG. 21.

Figure 23:
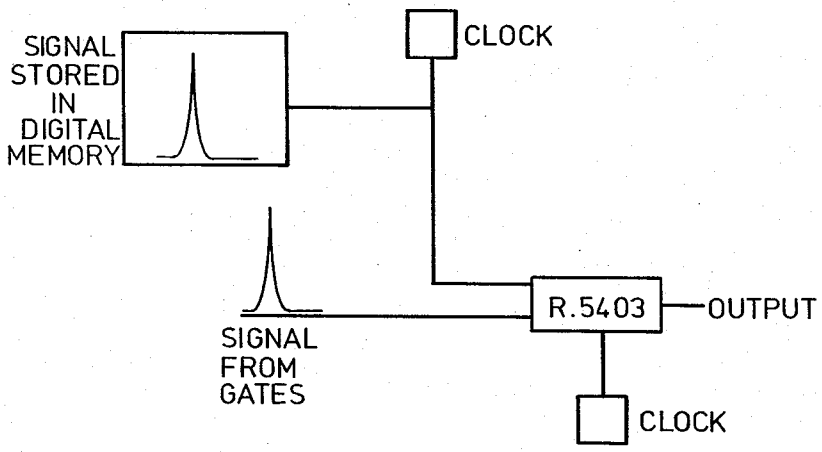

FIG. 23 is a diagrammatical view of the alternate method of recognizing the signal by correlation.

FIG. 24 is a diagrammatical view to assist in the explanation of correlation.

DETAILED DESCRIPTION OF INVENTION

General Description

In the preferred embodiment of this invention, the improved system for detection of marked or tagged objects within a magnetic field has been adapted to comprise an improved anti-shoplifting device generally depicted in FIGS. 1, 2 and 3.

FIG. 1 includes two coil housing units 2 and 4 which have a surveillance zone 6 intermediate said spaced coil housing units 2 and 4. The two coil housing units 2 and 4 are adapted to generate an oscillatory electromagnetic interrogation field within said surveillance zone 6 in a manner to be described herein.

A marker element, tag or label generally illustrated as number 8 in FIG. 2 is attached to each object or article (not shown) to be surveyed by the system described herein. When there has been an unauthorized passage of the label 8 through the surveillance zone 6 (as in the case of shoplifting) the label 8 will cut or link a sufficient number of generated lines of flux thereby generating a signal to be received by the coil housing units 2 and 4. The signal is communicated to an electrical detection circuitry 10 by means of electrical conductors 12 and 14, which will activate the alarm 44.

When the shopper has paid for the article or object the label 8 is inserted into the deactivating device 46 illustrated in FIG. 3. The deactivating device 46 will deactivate the label 8 so that when the label 8 is passed through the surveillance zone 6 there are no signals generated by the label 8; this avoids any false alarm of shoplifting through alarm 44.

Coil Housing Units

The coil housing units 2 and 4 are each more particularly described in FIGS. 4 and 5. Each coil housing unit 2 or 4 is so constructed and driven repetitively alternatively in phase (or aiding mode) and out of phase (or opposition mode) such that a label 8 will cut or link a sufficient number of lines of magnetic flux generated by the two magnetic field producing coil housing units 2 and 4 at some point doing its traversal through the interrogation zone 6 regardless of its angle with respect to the magnetic field producing coil units 2 and 4.

Geometric Construction of Coil Housing Units

In the preferred embodiment the coil housing units 2 and 4 respectively include a transmitting coil 48 having four turns as illustrated in FIGS. 4 and 5. Each of the turns of transmitting coil 48 are insulated from each other by insulating material 40. The transmitting coil 48 is wound in a parallelogram configuration as illustrated in FIG. 4. The slope of the two longest inclined members 22 and 24 respectively are approximately 25° from the horizontal plane. The other two shorter members 26 and 28 respectively are in the vertical position. The length of the inclined members 22 and 24 and the length of the vertical members 26 and 28 are 46" and 19" respectively.

The transmitting coil 48 is disposed in such a manner that the vertical member 26 at the point of entry extends from 10" to 29" above the floor and the vertical member 28 at the point of exit extends from 29" to 48" above the same floor. The field generated from the transmitting coil 48 so disposed will in the case of the vertical members 26 and 28 respectively have the same effect as a longer single conductor whose length is from 10" to 48" continuous and shall produce lines of flux generally in the horizontal plane.

The vertical member 28 has been designed to commence at a point 29" above the ground, which is the same height that vertical member 26 extends to, so as to avoid designing a system having a gap in the horizontal magnetic lines of flux generated by the vertical members 26 and 28 respectively. Accordingly, the horizontal magnetic lines of flux generated by the two short vertical members 26 and 28 will have the same effect as a continuous longer conductor whose length extends from 10" to 48" above the floor.

Inclined member 22 commences at a height of 29" above the floor, and terminates at a height of 48" and is 46" long; inclined member 24 commences at a height of 10" above the floor and terminates at a height of 29" above the floor and is also 46" long. The slope of both long members 22 and 24 is approximately 25° from the horizontal; and the lines of flux generated by the long members 22 and 24 respectively are generally 25° from the vertical. Since said lines of flux are generated 25° from vertical from conductors that begin at 10" and terminate at 29" in height above the floor, an equivalent single conductor whose lines of flux were 25° from the vertical would have a length of 92" maintaining the same slope.

Figure 6:
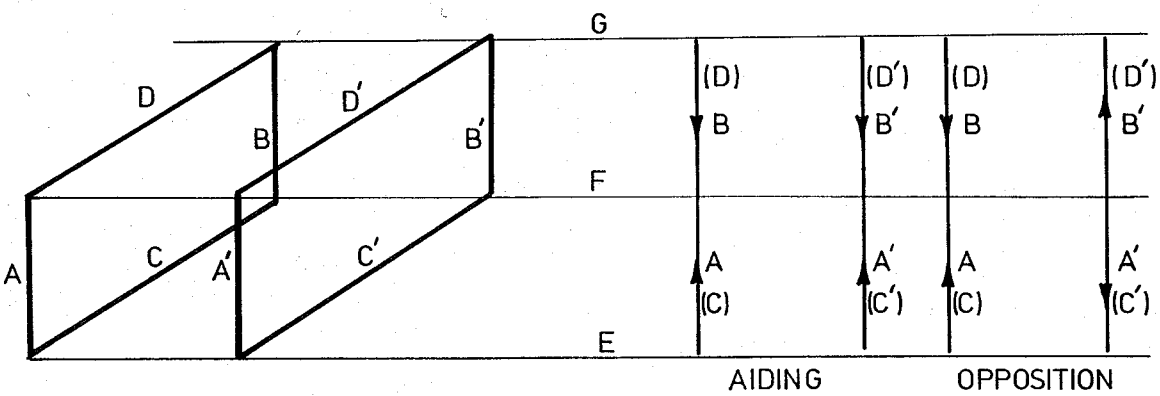
FIG. 6 is a diagram to assist in the explanation of the operation of the aiding and opposition mode.

As disclosed in FIG. 6, one notable exception to the similarity of conductors A, B and C, D with respect to the above mentioned equivalent longer conductors is that the electrical current travelling in A and B and also in C and D will be in opposite directions, since the reference members are in all cases on opposite sides of the transmitting coil 48 and the electrical current which always flows in the same direction at the same point in the time domain of a continuous conductor, will necessarily be flowing in the opposite direction due to the geometry of the transmitting coil 48 and the fact that the sides are opposite. Therefore, if the current were flowing in an upward direction in element A, it would have a downward direction in element B and likewise for elements C and D.

Driving Coils in Phase and Out of Phase

The transmitting coil 48 in each of the coil housing units 2 and 4 are driven by an alternating current source; however the alternating current source applied to one of the transmitting coils 48 in coil housing unit 2 is fixed while the alternating current applied to the other transmitting coil 48 in the coil housing unit 4 is operated so that the alternating current within transmitting coil 48 of coil housing unit 4 is in phase with the alternating current within transmitting coil 48 of coil housing unit 2 for a portion of time, and is then out of phase for a portion of time.

FIG. 7*a* is a schematic illustration of the transmitting coil 48 in coil housing unit 2 and FIG. 7*b* is a schematic illustration of the transmitting coil 48 in the coil housing unit 4.

FIG. 8*a* is a graphic illustration of the alternating current along corresponding points of the transmitting coil 48 in coil housing units 2 and 4 when the transmitting coils 48 are operated in phase or in the aiding mode. FIG. 8*b* is a graphic illustration of the alternating current along corresponding points of transmitting coil 48 in coil housing units 2 and 4 when the transmitting coils 48 are driven out of phase or in the opposition mode.

Consideration must now be given to the case of the generated magnetic field or lines of flux generated in the aiding and opposition modes of operation.

Vectors Produced in the Aiding and Opposition Modes of Operation

In the case of the aiding configuration, it is noted that conductors A and $A^1$ (which represents the portion of transmitting coil 48 in the vertical members 26 in the coil housing units 2 and 4 respectively) have electrical current travelling in the same direction, but conductors A and $A^1$, are displaced in space by their separation distance of about 38" center to center. By applying the right-hand rule with respect to the flux generated by an electrical current travelling in a conductor, it is observed that the lines of flux at a point equidistant from the two conductors A and $A^1$ shall have an opposite direction and shall in fact cancel if the current in the two conductors were the same.

The same dicussion applies to the flux producing elements B and $B^1$. Generally, the same applies to D and $D^1$, and C and $C^1$, with the exception that these flux producing elements In the case of the opposition configuration, it is noted that conductors A and $A^1$ have electrical current travelling in opposite directions, but conductors A and $A^1$ are displaced in space by their separation distance of about 38" center to center. By applying the right-hand rule with respect to the flux generated by an electrical current travelling in a conductor it is observed that the lines of flux at a point equidistant from the two conductors shall have the same direction and shall add and produce twice the flux if the current in the two conductors were the same.

This addition to produce twice the flux if the electrical current in the two conductors were the same holds true for flux producing elements B and $B^1$, and also to C and $C^1$, and D and $D^1$, with the exception that the latter four flux producing elements have a slope of about 25°.

It is further understood that the predominant field or lines of flux generated by the transmitting coil 48 are in a vector perpendicular to the place in which the coil exists and that the strongest field is within, or through the transmitting coil 48, since all four sides or current producing members add to one another. The magnetic field in the center of the coil 48 would be about four times as much as the fringing field as if a measurement were made at a distance equal to $\frac{1}{4}$ of the sum of the distance from the center to each edge of the conductor, from any one of the conductors on the outside of the coil 48.

FIG. 10 illustrates that three vectors of magnetic flux are generated in the surveillance zone 6 over a height of at least 10" to 48" above the floor, and that two of the vectors are perpendicular with respect to one another while the third vector is displaced 25° from the vertical.

The aiding configuration is used primarily to produce the magnetic field which is generally at a point in the center of one of the coils perpendicular to the plane in which the coil lies and is in the same direction as the other transmitting coil 48 at the same point in time domain producing the strongest field of the three vectors produced, as illustrated in FIGS. 9 and 10.

The opposition configuration as illustrated in FIG. 9 and 10 is used to generate the fringing fields that produce the other two vectors, and that the exact vector produced will be determined by the plane in which the two conductors lie. The vector produced in the opposition configuration will be at right angles with respect to said conductors. The fringing fields add at points equidistant from the two conductors. All other points between the two conductors produce a strong magnetic field across the entire 38" spread in all vectors.

Fundamental Frequency

In the preferred embodiment, the transmitting coils 48 in coil housing units 2 and 4 are driven in phase for 13 to 15 milliseconds. During this time interval an oscillating magnetic field is generated; the vector of said generated magnetic field is perpendicular to the face of the transmitting coils 48 as illustrated in FIGS. 9 and 10. The application of alternating current to transmitting coil 48 in coil housing unit 4 is then stopped for 8 milliseconds so as to allow switching said alternating current to drive the transmitting coil 48 in coil housing unit 4 in the out of phase mode as previously described. During the opposing configuration an oscillating magnetic field is generated having two vectors, one of which is perpendicular to the plane formed by the two conductors A and $A^1$ and that the other of which is perpendicular to the plane formed by the conductors B and $B^1$. The transmitting coils 48 in coil housing units 2 and 4 are driven in the out of phase mode for 13 to 15 milliseconds.

The cycle of generating one vector in the aiding configuration for 13 to 15 milliseconds, stopping for 8 milliseconds, and then generating the vectors in the opposing configuration for 13 to 15 milliseconds is repeated during the entire operation of the antishoplifting system.

In this manner, the transmitting coils 48 of coil housing units 2 and 4 generate a prescribed fundamental frequency suitable to resonate the coils 48 in coil housing units 2 and 4. In the preferred embodiment the capacitance and inductance of the transmitting coils 48 in coil housing units 2 and 4 are selected so that they operate in resonance to generate an oscillating magnetic field having a fundamental frequency of 12.5 KHz, which is graphically illustrated in FIG. 12.

Marker Element

As previously described the transmitting coils 48, in coil housing units 2 and 4, operate in resonance to generate an alternating magnetic field having a fundamental frequency of 12.5 KHz. During this in phase operation, a magnetic field will be generated in the surveillance zone 6, whose vector is orientated as described in FIGS. 9 and 10. During the out of phase operation, a magnetic field will be generated in the surveillance zone 6, having two vectors as described in FIGS. 9 and 10.

Since an oscillating magnetic field is generated having three separate and distinct vector components, any label 8 which traverses through the interrogation zone 6, will be cut or link a sufficient number of lines of flux at some point during its passage through the field, regardless of the angle of the orientation of the label 8.

The label 8 of the preferred embodiment consists of the use of Supermalloy. The prior art discloses the use of a Supermalloy marker element 8 having a maximum permeability of 800,000 and a coercive force of 0.002 Oersteds. However, the label 8 used in the preferred embodiment comprises an alloy, similar to Magnetics Inc. No. 25-7904 which has a maximum permeability of 100,000 and a coercive force of 0.05 Oersteds.

The prior art also discloses that the use of grain or domain orientated material was necessary in the use of marker elements 8. However, a label 8 having a unipole orientation may be utilized where the anisotrophy is such that the Hc is the same regardless of whether the applied magnetic field is parallel to the longest dimension or the shortest one.

In the preferred embodiment, the label 8 comprises of ferromagnetic material 30, which is magnetically soft or easily magnetized. When the label 8 passes through the magnetic field oscillating at the fundamental frequency of 12.5 KHz, the ferromagnetic material 30 becomes magnetized by the oscillating magnetic field. As the oscillating magnetic field alternates, the ferromagnetic material 30 switches poles at a fundamental frequency of 125 KHz and induces perturbations or anomolies on the oscillating lines of flux of the generated magnetic field. This induced signal has a fundamental frequency of 125 KHz and harmonics thereof which combine with the fundamental frequency of the generated magnetic field, as illustrated in FIG. 13. The signal generated by the label 8 is depicted as number 32 in FIG. 13.

The upper most detectable signal generated by the marker element 8 in response to being excited by a fundamental frequency of 12.5 KHz shall be approximately the 160th harmonic or 2 MHZ. The prior art discloses that harmonics of $10^6$ are detectable which is not true.

The harmonic signal 36 is received by a receiving coil 32, located within coil housing units 2 and 4.

As previously stated the marker elements 8 may be deactivated in the deactivating device 46 so that no signals 32 will be generated in the surveillance zone 6 during the passage therethrough. This is accomplished by including magnetically hard material 34 within the label 8 which becomes magnetized in deactivating system 46 to such an extent that the magnetically hard material 34 will prevent the switching of the ferromagnetic material 30 in surveilance zone 6.

Receiving Coil

The receiving coil 36 is more particularly disclosed in FIGS. 4 and 5. The particular configuration of the receiving coil 36 is that of a figure eight. The reasoning behind the particular choice is that the receiving coil 36 acts as a passive filter element; that is, if the area of the two halves of figure eight are the same, the fundamental frequency of 12.5 KHz is nulled or substantially eliminated; yet, the signal 32 induced by the marker element 8 is not nulled, since the marker element 8 cannot be in both regions of the figure eight at the same time.

In the preferred embodiment, the receiving coil 36 comprises of ten turns of wire located in a wire ribbon cable, the ends being so interconnected such that a ten turn coil is formed, as illustrated in FIG. 5. Since the receiving coil 36 is comprised of ten turns of wire, the receiving coil 36 also acts as a passive gain stage; that is, by utilizing ten turns a voltage gain of 10 is accomplished.

Electrostatic shielding 38 is placed over the receiving coil 36 so as to shield the receiving coil 36 against receiving electrostatic signals from the ambient atmosphere. However, it is obvious that the electrostatic shielding 38 does not extend over the entire extent of the figure eight of the receiving coil 36, otherwise, the electrostatic shielding 38 would change the characteristics of the receiving coil 36.

Other receiving coils used in the trade have a resonant frequency of approximately 130 KHz, which is where most of the energy from the signal 32 of the label marker element 8 lies.

The receiving coil 36 herein, is designed to have a much higher resonant frequency than used in the trade. In the preferred embodiment the resonant frequency of the receiving coil 36 is 280 KHz. The reason why the receiving coil 36 was designed to have higher resonant frequency than the signal 32 generated by the label 8 is that a coil when excited at its resonant frequency will ring or resonate; once a receiving coil 36 rings, one loses the characteristic of the exciting signal and obtains the characteristic of the receiving coil 36, and accordingly, the signal 32 generated by the label 8 loses its distinctiveness.

A flat ribbon cable is used to form the receiving coil 36 since it has a lower distributed capacitance and gives a resonant frequency of approximately 280 KHz.

The receiving coil 36 is made more lossy by the placement of one K ohm resistor across its terminals as illustrated in FIG. 14. The K ohm damping resistor is added to prevent the receiving coil 36 from ringing with anything but a large signal at its resonant frequency.

Therefore, a receiving coil 36 is disclosed which has a filter gain system with a broad band pass of about 280 KHz with a gain of ten that does not distort the signal at all and yet, is a passive element.

It is important that the phase of the receiving coil 36 match that of the transmitting coil 48 so as to maximize the capture of signal 32 generated by the label 8 in response to the in and out of phase generation of oscillating magnetic field produced by the transmitting coils 48.

Accordingly, the phase of the receiving coil 36 mounted adjacent the transmitting coil 48 within coil housing unit 2 is wired so as to be in phase with the transmitting coil 48 in coil housing unit 2. Since the phase of the transmitting coil 48 in the coil housing unit 2 is held constant the phase of the receiving coil 36 in coil housing unit 2 is also held constant.

The phase of the receiving coil 36 mounted adjacent the transmitting coil 48 within coil housing unit 4 is wired so as to be in phase with the transmitting coil 48 in coil housing unit 4. Since the phase of the transmitting coil 48 in coil housing unit 4 is alternated to be in and out of phase with respect to the transmitting coil 48 in coil housing unit 2, receiving coil 36 mounted within coil housing unit 4 is wired in phase with respect to the transmitting coil 48 in coil housing unit 4 so as to be alternating in and out of phase with respect to the receiving coil 36 in coil housing unit 2, but remain in phase with transmitting coil 48 in coil housing unit 4. Therefore, the phase of the receiving coil 48 in coil housing unit 4 remains in phase with the transmitting coil 48 in coil housing unit 4 as the phase of the transmitting coil 48 in coil housing unit 4 is switched to be in and out of phase with respect to the transmitting coil 48 in coil housing unit 2.

Electronic Circuitry

Once the signal is recovered from the receiving coil 36 without any wave shaping the signal 32 is extracted from the signal without substantial alteration by the electronic circuitry generally depicted as number 10 in FIG. 1 and more specifically itemized in FIG. 14.

FIG. 14 is a block diagram of the circuitry which extracts the generated signal 32 and which is capable of differentiating between object signals. The block diagram includes two receiving coils 36, impedance matching and gain stages 15A and 15B, summing station 16, high-pass filter system 17, low-pass filter system 18, automatic gain control stage 19, time card and time domain blanking stage 20, signal recognition stage 21 and alarm circuitry 14.

Impedance Matching Stage 1A and 1B

FIG. 15 illustrates the impedance matching stage generally referred to as 15A and 15B in block diagram of FIG. 14.

When wire is added to the receiving coils 36 the capacitance of the receiving coils 36 increases; accordingly the impedance matching stage 15A and 15B is necessary so that the coax connecting the receiving coil to the interrogator will not detune the receiving coil 36.

The impedance matching stage 1A and 1B also includes a gain stage. In practice it was discovered that by adding gain at this point, the signal to noise ratio (S/N) was greatly improved. The gain is so designed that the fundamental frequency of 12.5 KHz is not amplified nd the lower cut-off frequency is 96 KHz. This stage has a gain of 20 for frequencies above 100 KHz and below 400 KHz and a gain of approximately unity at the fundamental frequency of 12.5 KHz. The upper cut-off frequency of 400 KHz was inserted to eliminate the radio frequency pick up from the receiving coil 36.

The values for the various electrical components of the impedance matching and gain stage are disclosed in FIG. 15.

The impedance matching and gain stage essentially amplifies the fundamental frequency of signal 32 twenty times while the fundamental frequency of the oscillating magnetic field is amplified by one. In this manner the fundamental frequency generated by the label 8 is emphasized so as to facilitate its analysis.

Summing Stage

FIG. 16 particularizes the summing stage generally referred to as 16 in block diagram of FIG. 14. When the signals from either gate of 1A or 1B reach the interrogator they will be summed together, as a weak signal from the center of the gates will be doubled in amplitude and then only circuitry needed to handle one signal will be required.

Filtering System

The signal e out is then processed through a filtering system (which will be more fully described herein) with maximum care being given to do as little wave shaping as possible, since the electronic circuitry described herein is adapted to isolate the distortion caused by the label 8, therefore the electronic circuitry must be designed so as not to cause or generate a distortion through our own faulty systems.

Care must be given to the filtering system utilized otherwise problems result where due to system non-linearities which are induced by our own system signals could be generated which look very similar to the generated marker element signal 32.

For this reason, one preferred filtering technique is the use of a transversal filter in a band-pass configuration such as a sampled data filter which is linear in phase. These filters typically have transition rates exceeding 150 dB/octave, and have more than 40 dB stop band rejection making them ideal for critical filtering situations.

Where less critical filtering is acceptable, the more common types of design, such as Butterworth may be employed with the final result being that some additional processing may be required to give close to the accuracy of a system employing a transversal filter.

High-pass Filter

FIG. 17 illustrates the high-pass filter utilized in the preferred embodiment. The cut-off frequency is selected to be high enough with a steep enough slope to effectively remove the fundamental frequency of 12.5 KHz from the signal; but leaving enough lower order harmonics to be able to descriminate signals which generate larger lower order harmonics along with higher order harmonics such as pop cans and large ferrous objects.

A Butterworth's filter (flattest response) was utilized so that the signal is free from any wave shaping. It was determined that a 60 KHz lower cut-off frequency and a scope of 24 dB per octave gave the best results.

Referring to FIG. 17 C1, C2, C3 and C4 are each 260 picofarads and the integrated circuits IC1 and IC2 are each NE 5534 ultra low noise with 15 MHz band width. There is a component tolerance of 5%.

The high-pass filter imparts a slight gain of 2.6 or amplification of 8.3 dB to the signal e in.

Low-pass Filter

FIG. 18 illustrates the low-pass filter of the preferred embodiment generally referred to as 18 in FIG. 14. Since a high-pass filter enhances noise, a low-pass filter with a flat response was installed to clean up the signal and get rid of any radio frequency that was picked up by the circuit.

The upper cut-off frequency of the low-pass filter was determined experimentally to operate optimumly at 500 HKz or more. Integrated circuits IC3 and IC4 are each NE 5534 type ultra low noise 15 MHz Bu. Capacitors C1, C2, C3 and C4 each have values of 39 picofarads.

The low-pass filter imparts a gain of 2.6 to e in or amplifies e in by 8.3 dB.

Automatic Gain Control Stage

Once the signal has been filtered, it is passed through an automatic gain control stage 19 so that the amplitude of each signal will be substantially equal before attempting signal recognition.

FIG. 19 generally discloses the automatic gain control stage 19 illustrated in FIG. 14.

A fairly efficient automatic gain control system is required having a dynamic range of 60 dB without distortion. The automatic gain control system must be designed so as to accommodate a very weak signal in the middle of the gates (2mv) or a strong signal almost touching the gate (500 mv). The output of the automatic gain control will be constant therefore all signals will be of equal amplitude when attempting signal recognition.

The gate input signal is first amplified than part of this signal is sent to the feedback network which will control the level of the input to maintain a constant generated output.

FIG. 19*a* depicts the automatic gain control stage utilized in a preferred embodiment. The integrated circuit IC1 utilized in the automatic gain control stage in the preferred embodiment comprises an NE 5534 integrated circuit.

Time Domain Blanking

Since the signal 32 generated by the label 8 occurs only at certain points in time corresponding to the in phase and out of phase timing any signal generated during any other interval of time may be blanked out by a time domain blanking circuit so as to further eliminate any false alarms.

FIG. 20 generally illustrates the time domain blanking circuit.

When the signal has been retrieved correctly it will appear only at certain points in time corresponding to in phase and out of phase timing. If one blanks the signal out except for the correct moment only those signals generated by the label 8 will appear.

In previous systems time domain blanking was implemented but since the signal was ringing, the signal would spill over into the time when the label 8 signal would appear and thus cause a false alarm. The stronger the signal, the longer the ring and the more likely that it would spill over into the time domain where the signal from the label 8 would appear. Therefore, in previous systems a strong signal from something like a pop can would ring long enough to spill over into the time where the signal 32 from the label 8 would appear and thus cause a false alarm.

Since the precise location of the signal 32 is known the aperture in the time domain blanking circuit can be made much narrower so as to eliminate further the possibility of false alarms.

The time domain blanking circuitry used in the preferred embodiment is more particularly disclosed in FIG. 20*a*.

Signal Recognition

Once the signal has been retrieved, kept at a uniform amplitude, and having 95% of the false signals discarded by utilizing time domain blanking, the signals can then be analyzed to determine whether it is the correct signal.

Two methods for analyzing or recognizing the signal are pulse width detection and correlation.

Pulse Width Detection

Once the signal 32 has been retrieved without altering its characteristics it must then be analyzed in order to determine whether it is the signal of interest.

One method of recognizing a signal is by utilizing the pulse width detection circuitry illustrated in FIG. 21.

The exact width of the signal 32 should be 4 uv. All other objects which might give off harmonics would be much slower and have longer widths or pulses. For example a pop can would have a pulse width of approximately 8 uv. Any spurious noise pulses would be of a higher frequency having narrower pulses.

FIG. 21 in conjunction with FIG. 22 describes electronic circuitry which will only generate an output for a pulse having specified limits. A pulse longer or shorter in time will not generate an output.

The lower time TL which is equal to TA in FIG. 21 is set by varying RA and CA. The upper time TU is equal to the sum of TA plus TB. The value of TB can be set by varying RB and CB.

FIG. 22 illustrates that if the test pulse TPW is less than TL there is no output; and that if the test pulse is greater than GU there is also no output. However, when TPW is greater than TL and less than TU as in the case or recognizing the generated signal 32 an output will be generated which will activate the alarm 44.

Correlation

An alternative method of recognizing the signal 32 is by the use of correlation.

Cross-correlation is a mathematical operation which indicates the degree of similarity between two signals.

The mathematical function is as follows:

$$Rxy\,(Tn) = \sum_{m=0}^{m-1} x(m)y(m - Tn)$$

x = first signal
y = second signal
Tn = time broken up into intervals
m = total number of divisions In particular cross-correlation means that if two signals x and y are utilized, one signal x would be held stationary and the other signal y would slide past the first stationary signal x. The signals x and y would be divided up into a certain number of parts. Then at regular intervals one signal y slides against the other signal x; this multiplies the corresponding parts together. The sums are then added. The output is maximized when two identical signals line up, giving a maximum output proportional to the degree of similarity of the signals.

FIG. 24 discloses two signal wave forms, where one signal is held stationary and the other will slide by the held signal. Each signal is divided up into thirty-two equal segments. The segments on the held signal are identified as a, b, c, d, etc. The segments of the this sliding signal are also identified as a, b, c, d, etc.

The mathematical relation that exists is as follows:

$$(a \times a) + (b \times b) + \ldots$$

This is repeated at every segment as one signal slides relative to the other.

FIG. 23 describes an integrated circuit manufactured by Reticon Corporation of California which will perform the correlation function (R 5403). This integrated circuit can be utilized to store a replica of the signal in memory and clock it into one register of the integrated circuit. The signal 32 is clocked into one register of the integrated circuit.

Correlation may be the ultimate solution for signal recognition as it is possible to alter the signal 32 from the label 8 from one label 8 to the next at the manufacturing level and thus differentiate between the different signals 32 from the different label 8. Both signals could be stored to set off the alarm. However, correlation is a much more expensive proposition.

Correlation may also be accomplished by utilizing a pair of charge-transfer devices each with thirty-two taps equally spaced one sample time apart along the device, along with a pair of thirty-two bit binery shift registers for providing binery weighting of the analogue taps and thereby providing correlation.

Additional Signal Processing

When working with weaker signals caused by either spreading the transmitting coils 48 further apart in order to afford a wider passage way and a larger surveillance zone 6, or by reducing the label 8 length to extend its utility and reduce its costs another method of signal recognition, is the use of signal averaging. In a preferred form, signal averaging consists of two charge-transfer devices, each with thirty-two taps equally spaced one sample time apart, but with the taps individually connected to a set of capacitors by means of a transfer gate. Each set of capacitors also has a reset switch to delete the previously stored information before accepting signals from a new signal interration cycle, thus allowing flexibility in selecting any number of signals to be averaged with a signal processing algorithm based on the first order differential equation of each of the individual storage sights or taps. The algorithm is effectively the same as that of a single pole recursive filter; however, it is not subject to the degradation of the signal to noise ratio inherent in recursive integration passed by the process recycling a "coherent noise".

Whereas, the present invention has been described with respect to specific embodiments thereof, it will be understood that various changes and modifications will be suggested to one skilled in the art, and it is intended to encompass such changes and modifications as fall within the scope of the appended claims.

The embodiments of the invention in which an exclusive property or privilege is claimed are defined as follows:

1. In a system for detecting the passage of an object through a surveillance zone, the combination including; means for generating an oscillatory magnetic interrogation field within said surveillance zone, said magnetic field having three separate and distinct vector components therewithin by driving transmitting coil means flanking said surveillance zone with an alternating power source repetitively in and out of phase with respect to one another so as to produce oscillating magnetic lines of flux having one vector component at the time the transmitting coils are in the aiding configuration that forms the in-phase mode and two vector components at the time the transmitting coils are in the opposing configuration that forms the out-of-phase mode; ferromagnetic marker means attachable to an object; and means for detecting a signal generated by said marker means in response to said generated oscillating magnetic lines of flux within said surveillance zone.

2. In a system as claimed in claim 1 wherein said detection means include circuitry for time domain blanking and circuitry for signal recognition.

3. In a system as claimed in claim 2 wherein said time domain blanking circuitry permits the entry to said signal recognition circuitry of said signal generated by said ferromagnetic marker and received by said detection means during a predetermined timed interval corresponding to said in-phase and out-of-phase mode switching and eliminates all other signals during all other time periods from entry to said signal recognition circuitry.

4. In a system as claimed in claims 2 or 3 wherein said signal recognition circuitry includes pulse width detection circuitry for detecting the pulse width of said signal generated by said ferromagnetic marker.

5. In a system as claimed in claim 2 or 3 wherein said signal recognition circuitry includes correlation circuitry for detecting said signal generated by said ferromagnetic marker.

6. In a system as claimed in claim 1 and further comprising a marker for use in a system for detecting the presence of an object within an interrogation zone of an oscillating magnetic field having three distinct and separate vector components, said marker adapted to be secured to an object, the presence of which is to be detected in said surveillance zone; said marker including an elongated, thin, ferromagnetic strip of magnetically soft alloy with maximum permeability of the order of 100,000 and having a coercive force of the order of 0.05 Oersteds, and including smalller quantities of magnetically hard material which can be magnetized so as to prevent the switching of said ferromagnetic strip in said interrogation zone.

7. In a system as claimed in claim 6 including means for deactivating said marker so that said marker may pass through said surveillance zone without detection.

8. In a system as claimed in claim 6 wherein said marker has a unipolar orientation whereby the anisotrophy is such that the Hc is the same regardless of the orientation of said marker within said oscillating magnetic field.

9. In a system as claimed in claim 6 or 8 wherein said ferromagnetic strip generates harmonic frequencies to approximately the 160th harmonic or 2 MHz in response to being excited by a fundamental frequency of 12.5 KHz.

10. In Detection apparatus, a pair of coil housing units flanking a surveillance zone and adapted for the generation of an oscillating magnetic field having three distinct and separate vector components within a surveillance zone and for the detection of signals from a ferromagnetic marker means passing through said surveillance zone, each said coil housing unit including; a plurality of transmitting coil means mounted in said coil housing unit; circuitry means associated with said transmitting coil means for generating from said transmitting coil means an oscillating magnetic field having a predetermined fundamental frequency; receiving coil means mounted in said coil housing unit and adapted to receive signals generated by a ferromagnetic marker means in response to said generated oscillating magnetic field within said surveillance zone, whereby said receiving coil means is adapted to substantially eliminate said fundamental frequency and amplify said signals generated by said ferromagnetic marker means; and said coil housing units are so connected that said transmitting coils are in an aiding configuration part of the time and in an opposing configuration part of the time.

11. Detection apparatus as claimed in claim 10 wherein said transmitting coil means comprise a plurality of conducting loops in a parallelogram configuration.

12. Detection apparatus as claimed in claim 11 wherein the slope of the horizontal members of said parallelogram configuration are at an acute angle from the horizontal.

13. Detection apparatus as claimed in claim 12 wherein said acute angle is 25°.

14. Detection apparatus as claimed in claim 1 wherein the capacitance and inductance of said transmitting coil means are selected to tune said conducting loops to a predetermined fundamental frequency.

15. Detection apparatus as claimed in claim 11 wherein said conducting loops consist of on the order of four turns of ribbon wire.

16. Detection apparatus as claimed in claim 10 wherein said receiving coil means are mounted in a figure eight configuration.

17. Detection apparatus as claimed in claim 16, wherein said receiving coil means consists of turns of flat ribbon cable, the ends being so interconnected that a coil of on the order of ten-turns is formed.

18. Detection apparatus as claimed in claim 10 wherein said receiving coil means are wired in phase with said transmitting coil means within each coil housing unit respectively.

19. In a method for detecting the passage of an object through a surveillance zone, including the step of generating an oscillating magnetic field having three separate and distinct vectors produced by driving transmitting coil means within an alternating source repetitively in and out of phase with respect to one another so as to generate oscillating magnetic lines of flux having one vector component at the time the transmitting coils are in the aiding configuration that forms the in-phase mode and two vector components at the time the transmitting coils are in the opposing configuration that forms the out-of-phase mode; the step of introducing a ferromagnetic marker attachable to an object within said surveillance zone; and the step of detecting a signal generated by said ferromagnetic marker in response to said generated oscillating magnetic lines of flux within said surveillance zone.

20. In a method as claimed in claim 19 wherein said detection step is followed by the step of filtering and amplifying said signal generated from said ferromagnetic marker in said oscillating magnetic interrogation field.

21. In a method as claimed in claim 20 wherein said filtering and amplifying step is followed by the step of distinguishing said signal generated from said ferromagnetic marker in said oscillating magnetic interrogation field from other signals by utilizing time domain blanking.

22. In a method as claimed in claim 21 wherein said distinguishing step distinguishes the pulse width of signals generated from said ferromagnetic marker in said oscillating magnetic field from other signals.

23. In a method as claimed in claim 21 wherein said distinguishing step includes the step of correlating said signals generated by said ferromagnetic marker in said oscillating magnetic field.

24. In a method as claimed in claim 19 wherein said detection step averages said signal generated by said ferromagnetic marker in said oscillating magnetic field.

25. Apparatus for generating an alternating magnetic field in a detection zone to produce harmonic signals from a metallic strip therein, comprising:

a first and a second coil of conductive material, each of said coils configured to have a plurality of essentially linear segments, a first group of said segments having each one thereof oriented at an acute angle relative to horizontal and a second group of said segments each one thereof oriented essentially vertically, said first and said second coils spaced apart to form the detection zone therebetween, means for producing in said second coil an aternating current in said first coil, and means for producing in said second coil an alternating current which alternates between being in-phase and out-of-phase with the current in said first coil.

26. The apparatus recited in claim 25 wherein the segments in said first group are each larger than the segments in said second group.

27. The apparatus recited in claim 25 wherein said second group of segments comprises first and second segments, the lower end of the first segment and the upper end of a second segment in a plane which is parallel to a surface supporting said apparatus.

28. A method for generating an alternating magnetic field in a detection zone to produce harmonic signals from a metallic strip therein, comprising the steps of:

positioning first and second coils in vertical planes and parallel at spaced apart locations to define the detection zone therebetween, each of said coils configured to have a plurality of essentially linear segments, a first group of said segments have each one thereof oriented at an acute angle relative to horizontal and a second group of said segments each one thereof oriented essentially vertically, producing an alternating current in said first coil, and producing in said second coil an alternating current which alternates between being in-phase and out-of-phase with the current in said first coil.

29. A method for generating an alternating magnetic field in a detection zone to produce harmonic signals from a metallic strip therein, comprising the steps of:

positioning first and second coils vertically and spaced apart to define the detection zone therebetween, said coils having elongated segments thereof orientated at an acute angle relative to horizontal, driving in-phase alternating currents through said coils to produce aiding horizontal magnetic fields from said coils during first periodic time periods, said aiding horizontal magnetic field perpendicular to said coils, and driving out-of-phase alternating currents through said coils to produce opposing horizontal magnetic fields perpendicular to said coils during second periodic time periods occuring alternately with said first periodic time periods.

30. In detection apparatus, a pair of coil housing units flanking a surveillance zone and adapted for the generation of an oscillating magnetic field having three distinct and separate vector components within a surveillance zone and for the detection of signals from a ferromagnetic marker means passing through said surveillance zone, each said coil housing unit including; a plurality of transmitting coil means mounted in said coil housing unit; circuitry means associated with said transmitting coil means for generating from said transmitting coil means an oscillating magnetic field having a predetermined fundamental frequency; receiving coil means mounted in FIG. 8 configuration in said coil housing unit and adapted to receive signals generated by a ferromagnetic marker means in response to said generated oscillating magnetic field within said surveillance zone and resistor means connected between the terminals of said receiving coil means.

31. In detection apparatus, a pair of coil housing units flanking a surveillance zone and adapted for the generation of an oscillating magnetic field having three distinct and separate vector components within a surveillance zone and for the detection of signals from a ferromagnetic marker means passing through said surveillance zone, each said coil housing unit including; a plurality of transmitting coil means mounted in said coil housing unit; circuitry means associated with said transmitting coil means for generating from said transmitting coil means an oscillating magnetic field having a predetermined fundamental frequency; receiving coil means mounted in FIG. 8 configuration in said coil housing unit said receiving coil means consisting of turns of flat ribbon cable with the ends being so interconnected that a coil of the order of 10 turns is formed, said receiving coil means being adapted to receive signals generated by a ferromagnetic marker means in response to said generated oscillating magnetic field within said surveillance zone and resistor means connected between the terminals of said receiving coil means.

* * * * *